US010804600B2

(12) United States Patent
Shapoury

(10) Patent No.: US 10,804,600 B2
(45) Date of Patent: Oct. 13, 2020

(54) ANTENNA AND RADIATOR CONFIGURATIONS PRODUCING MAGNETIC WALLS

(71) Applicant: The Boeing Company, Chicago, IL (US)

(72) Inventor: Alireza Shapoury, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 346 days.

(21) Appl. No.: 16/041,881

(22) Filed: Jul. 23, 2018

(65) Prior Publication Data

US 2020/0028247 A1 Jan. 23, 2020

(51) Int. Cl.

| | |
|---|---|
| ***H01Q 1/28*** | (2006.01) |
| ***H01Q 3/34*** | (2006.01) |
| ***H01Q 3/24*** | (2006.01) |
| ***H01Q 3/30*** | (2006.01) |

(52) U.S. Cl.

CPC ..... *H01Q 1/28* (2013.01); *H01Q 3/24* (2013.01); *H01Q 3/247* (2013.01); *H01Q 3/30* (2013.01); *H01Q 3/34* (2013.01)

(58) Field of Classification Search

CPC ..... H01Q 1/28; H01Q 3/34; H01Q 3/247; H01Q 1/18; H01Q 3/30; H01Q 3/24

USPC ..... 343/705

See application file for complete search history.

(56) References Cited

U.S. PATENT DOCUMENTS

| | | | | |
|---|---|---|---|---|
| 2009/0195471 | A1* | 8/2009 | Semonov | H01Q 1/246 343/810 |
| 2009/0273533 | A1* | 11/2009 | Wolf | H01Q 3/2682 343/770 |
| 2013/0207842 | A1* | 8/2013 | Small | H01Q 3/005 342/372 |
| 2016/0141754 | A1* | 5/2016 | Leyh | H01Q 3/247 342/372 |
| 2016/0254597 | A1* | 9/2016 | Weinstein | H01Q 9/065 343/872 |
| 2018/0358696 | A1* | 12/2018 | Shapoury | H01Q 21/0025 |
| 2019/0271762 | A1* | 9/2019 | Sakai | G01S 13/04 |

* cited by examiner

*Primary Examiner* — Hai V Tran

(74) *Attorney, Agent, or Firm* — McDonnell Boehnen Hulbert & Berghoff LLP

(57) ABSTRACT

Methods and systems for producing magnetic walls for use in a switchable or activated non-reciprocal antenna array are presently disclosed. The non-reciprocal antenna array includes a plurality of omni-directional antennas linearly aligned with a phase center of each omni-directional antenna antennas on a line. Each antenna of the plurality of omni-directional antennas has an antenna rotation respective to the line. The array also includes an antenna spacing between the antennas equaling 360 degrees divided by a quantity of antennas in a full operational wavelength. Additionally, the array includes a set of antenna feeds corresponding to one feed for each antenna. The set of antenna feeds is configured to selectively enable or disable the plurality of antennas. When the plurality of omni-directional antennas are enabled, the array has a composite radiation pattern in having a maximum in one direction perpendicular to the line and a minimum in an opposite direction.

20 Claims, 9 Drawing Sheets

ANTENNA AND RADIATOR CONFIGURATIONS PRODUCING MAGNETIC WALLS

FIELD

The present disclosure relates generally to an antenna system for use on an airborne platform, such as an airplane. In further examples, the antenna system may be used as a part of a radar system.

BACKGROUND

Radio detection and ranging (RADAR) systems can be used to actively estimate parameters of environmental features by emitting radio signals and detecting returning reflected signals. Radar systems can determine the distance to radio-reflective features according to a time delay between transmission and reception. Radar systems use antennas to emit a radio signal that varies in frequency over time, such as a signal with a time-varying frequency ramp or chirp, and then, based on the difference in frequency between the emitted signal and the reflected signal, estimate range. Some systems may also estimate the relative motion of objects causing radar reflections based on Doppler frequency shifts in the received reflected signals.

The antennas of a radar system may include an array of antennas. An array may be an arrangement of antennas that have a physical layout that produces desirable antenna properties. For example, antennas may be arranged in a linear array with all the antennas aligned on a line, a two dimensional array with all the antennas aligned on a plane, or other possible antenna array arrangements as well.

A phased array antenna is an antenna system, having multiple radiation elements, in which the radiation pattern can be steered in particular directions by controlling the relative phases of the signal delivered to each radiation element. A phased array antenna may be used for radar systems, communication systems, etc.

Commonly, the antenna arrays of the radar system may be mounted on an aircraft. Because the antennas are mounted on the aircraft, it may be desirable for the antenna arrays to radiate signals away from the aircraft. Generally, arrays are designed to radiate in a direction away from the aircraft in one of two ways. First, directional radiators may be used to form the array, where the radiators are pointed in a direction away from the aircraft. Second, an array may use a metallic ground plane or ground screen behind the antennas to image the radiating structure, to reduce back radiation and to allow installation of electronic subsystems, such as amplifiers and filters, right behind the radiator structure.

Directional radiators may be more complicated, larger and expensive to design and manufacture compared to omnidirectional radiators. To avoid the complexity of directional radiators, a radar system may be designed with non-directional radiators. However, when used in an aircraft-mounted radar system, non-directional radiators may have the undesired effect of radiating energy toward the aircraft. In order to mitigate the energy radiated toward the aircraft, an array of non-directional antennas are commonly used with a conductive or metallic ground plane behind the antennas to reflect radiation away from the aircraft.

Non-directional radiators may be omni-directional, which have non-directional pattern in one given plane but a directional pattern in any orthogonal plane. This is in contrast with isotropic radiators, which have a hypothetical radiation pattern of equal intensity in all directions. As isotropic radiators are hypothetical, in this disclosure we use an omni-directional radiator to describe physical radiating elements which have undesirable non-directional patterns toward an intended radiating direction.

Conductive or metallic grounds are also used in monopole radiators when these radiators are constructed above an imaging plane. These metallic grounds produce radiation patterns similar to a dipole radiator in the half-space above the imaging plane.

A conductive or metallic ground plane may also have some undesired effects as the metallic ground plane reflects incoming electromagnetic signals, as well as those radiated by the array. For example, incoming radar signals may be reflected as well.

SUMMARY

The present disclosure is designed to address at least one of the aforementioned problems and/or meet at least one of the aforementioned needs. By designing an array that uses omnidirectional radiating elements in a configuration that reduces the amount of energy radiated toward the aircraft, an antenna system may be created that has the benefits of ease of manufacturing, while removing the need for a conductive or metallic ground plane.

In one example, a switchable or activated non-reciprocal antenna array is described, which can be utilized only when desired. The activated non-reciprocal antenna array includes a plurality of omni-directional antennas linearly aligned with a phase center of each omni-directional antenna of the plurality of omni-directional antennas on a line in a periodic arrangement. Each omni-directional antenna has an antenna rotation respective to the line and a length of the period of the periodic arrangement approximately equals an operational wavelength, λ. The activated non-reciprocal antenna array also includes an antenna spacing between the omni-directional antennas of the plurality of omni-directional antennas, the antenna spacing equaling 360 degrees, or a full wavelength, divided by a quantity of omni-directional antennas that form the period. The antenna spacing can also be integer fractions or multiples of the aforementioned calculation while trading with antenna performance such as bandwidth, maximum beam scan angle, and electromagnetic field directivity. For example, it can consist of missing or duplicate neighboring similar or dissimilar radiating elements, which collectively achieve a given desired radiation pattern. Additionally, the activated non-reciprocal antenna array includes a set of antenna feeds corresponding to one feed for each omni-directional antenna of the plurality of omni-directional antennas. The set of antenna feeds is configured to selectively enable or disable the plurality of omni-directional antennas. When the plurality of omni-directional antennas are enabled, the array has a composite radiation pattern having a main lobe having a relative maximum in one direction substantially perpendicular to the line and a back lobe having a relative minimum in an opposite direction. When the plurality of omni-directional antennas are not enabled, and the antenna feeds are not properly configured, the structure does not exhibit electromagnetic characteristics similar to an enabled antenna, hence offering a non-reciprocal radiating structure.

In still another example, a method of operating an antenna array is described. The method may include feeding an electromagnetic signal to each omni-directional antenna of a plurality of omni-directional antennas. The plurality of omni-directional antennas that are fed are aligned with a phase center of each such antenna in a line in a periodic arrangement. A length of the period approximately equals an operational wavelength, λ. The feeding is configured to selectively enable or disable the plurality of antennas simultaneously. The method may also include radiating electromagnetic energy by the plurality of omni-directional antennas. The radiation of each omni-directional antenna is in a direction having a rotation respective to the line and the radiating is performed by a plurality of omni-directional antennas having a spacing that equals 360 degrees divided by a quantity of omni-direction antennas that form a period. When the omni-directional antennas are enabled, the array has a composite radiation pattern having a main lobe having a relative maximum in one direction substantially perpendicular to the line and a back lobe having a relative minimum in the opposite direction.

In another example, a periodic two-dimensional antenna array is described. The periodic two-dimensional array includes a plurality of omni-directional antennas arranged periodically, each period having a quantity of antennas. Each omni-directional antenna is aligned with a phase center of each omni-directional antenna of the plurality of omni-directional antennas on a plane of the array. Each omni-directional antenna further has an antenna rotation respective to the plane. Additionally, each omni-directional antenna has an antenna spacing between an adjacent omni-directional antenna that equals 360 degrees divided by the quantity of omni-directional antennas in the period. The periodic two-dimensional antenna array further includes a set of antenna feeds corresponding to one feed for each omni-directional antenna. The set of antenna feeds is configured to selectively enable or disable the plurality of omni-directional antennas. When the plurality of omni-directional antennas are enabled, the array has a composite radiation pattern in having a main lobe having a relative maximum in one direction perpendicular to the plane and a back lobe having a relative minimum in an opposite direction.

The features, functions, and advantages that have been discussed can be achieved independently in various embodiments or may be combined in yet other embodiments, further details of which can be seen with reference to the following description and drawings.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Figure 1A:
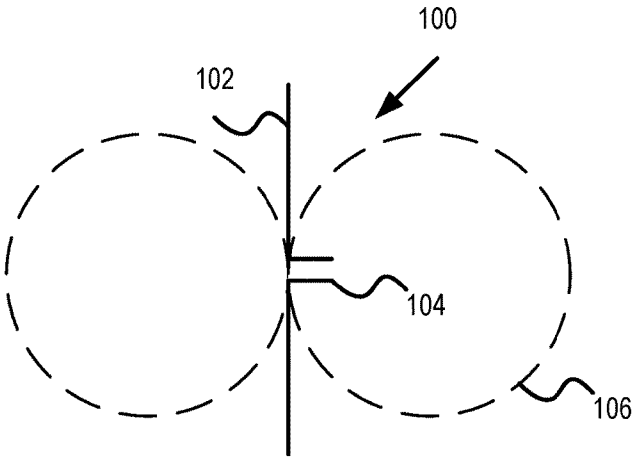
FIG. 1A (prior art)
FIG. 1A is a diagrammatic representation of an example dipole antenna and an example radiation pattern.

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art.

Examples, systems and methods for an antenna array for use in a radar system of an airborne platform are described. The present antenna array uses omnidirectional antennas, such as dipoles or loops, but other antenna types may be used as well. The present disclosure enables an array made of omni-directional antenna elements to radiate electromagnetic energy primarily in one direction. Because antennas are reciprocal elements, an antenna that radiates a signal in a given direction also can receive signals in the given direction. Therefore, when the term radiating is used in the present disclosure, it should be readily understood to also mean reception when appropriate.

For example, when discussing the radiation properties of an antenna or array, the same description applies to the antenna or array being used to receive signals as well. Additionally, the antennas disclosed herein are generally designed to operate at a frequency of 30 Gigahertz (GHz). Although 30 GHz is given as an example, other frequencies may be used as well. Additionally, in some examples, the present antennas may function over a bandwidth in or around 30 GHz.

By spacing the antenna elements with a predetermined spacing of the phase center of each respective antenna, and by having the antenna elements each having a predetermined rotation, the array may emit electromagnetic energy in one direction only, or substantially in only one direction, for example. It may be desirable to cause the radiation to be emitted in a direction away from the aircraft on which the array may be mounted. Because the radiation is emitted only in a direction away from the aircraft, the array may not need a metallic reflecting ground plane.

In some examples, rather than a metallic ground plane, the array may have a radio-absorbent material behind the array. The radio-absorbent material may prevent an incoming radio wave from being reflected. Therefore, during the operation of the array, when the antennas are enabled, they may transmit and/or receive radio signals. When the antennas are disabled, the array may not transmit or receive radio signals.

Additionally, when the antennas are disabled, the array may allow incoming radio signals to pass through to the radio-absorbing layer.

By using the techniques, methods, and devices of the present disclosure, an array may be manufactured that has desirable radiation properties. The array may also be relatively low cost to manufacture, as complex directional antenna elements may not be required.

Figure 1B:
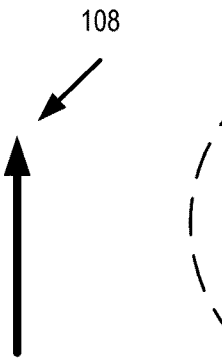
FIG. 1B (prior art)
FIG. 1B is a schematic representation of the example dipole antenna.
Figure 1C:
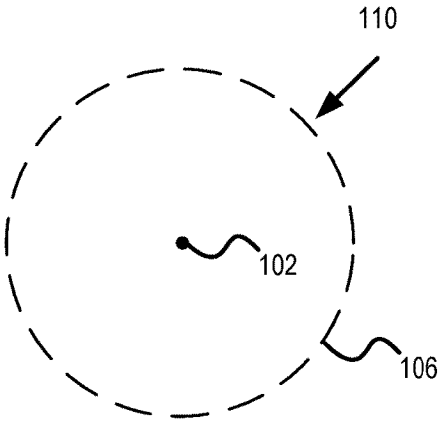
FIG. 1C (prior art)
FIG. 1C is another diagrammatic representation of an example dipole antenna and an example radiation pattern.

Referring now to the figures, FIG. 1A is a diagrammatic representation 100 of a dipole antenna 102 having a feed 104 and radiation pattern 106. FIG. 1B is a schematic representation 108 of the example dipole antenna 102 and FIG. 1C is a diagrammatic representation 110 of a dipole antenna 102 and radiation pattern 106. FIG. 1A shows the dipole antenna 102 from a side view and FIG. 1C shows dipole antenna 102 from a top-down view. To operate the dipole antenna 102, a signal is fed to the dipole antenna 102 by way of the feed 104. The dipole antenna 102 in turn radiates a portion of the signal fed in the direction of the radiation pattern 106.

The schematic representation 108 of the example dipole antenna shown represents the electric field vector for a positive cycle. The arrow would be in the opposite direction for a negative cycle. The schematic representation 108 may be used to represent a dipole antenna in the arrays of this disclosure. Additionally, due to the nature of electromagnetic waves, a full cycle of an electromagnetic wave has a positive cycle and a negative cycle. Therefore, the notation used herein generally describes the orientation of the vectors during the positive cycle. However, the same notation may be used to describe the negative cycle as well (with the arrows pointed in the opposite direction).

Figure 1D:
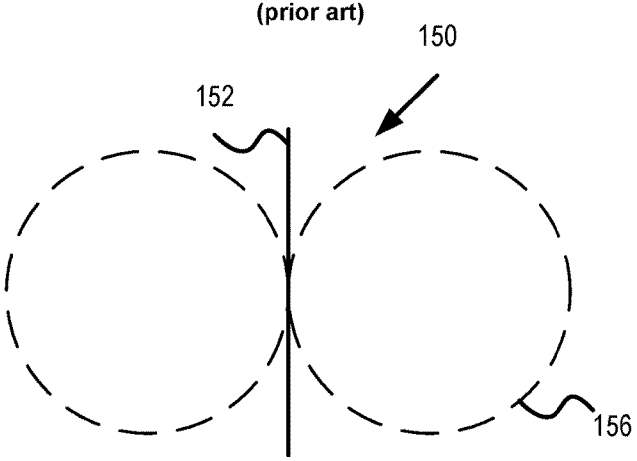
FIG. 1D (prior art)
FIG. 1D is a diagrammatic representation of an example loop antenna and an example radiation pattern.
Figure 1E:
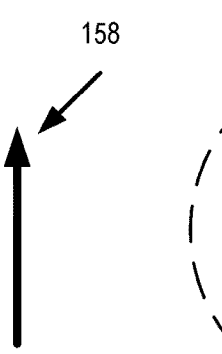
FIG. 1E (prior art)
FIG. 1E is a schematic representation of the example loop antenna.
Figure 1F:
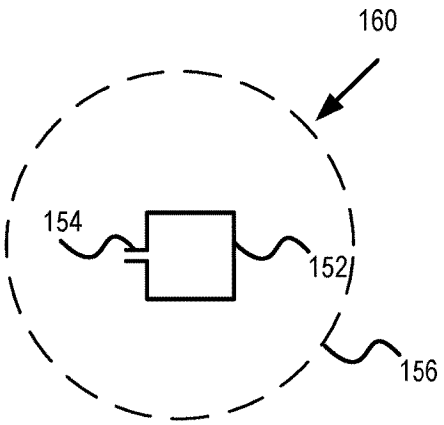
FIG. 1F (prior art)
FIG. 1F is another diagrammatic representation of an example loop antenna and an example radiation pattern.

FIG. 1D is a diagrammatic representation 150 of a loop antenna 152 and radiation pattern 156. FIG. 1D is a schematic representation 158 of the example loop antenna 152 and FIG. 1F is a diagrammatic representation 160 of a loop antenna 152 having a feed 154 and radiation pattern 156. FIG. 1D shows the loop antenna 152 from a side view and FIG. 1F shows loop antenna 152 from a top-down view. To operate the loop antenna 152, a signal is fed to the loop antenna 152 by way of the feed 154. The loop antenna 152 in turn radiates a portion of the signal fed in the direction of the radiation pattern 156.

The schematic representation 158 of the example loop antenna shown represents the magnetic field vector for a positive cycle. The arrow would be in the opposite direction for a negative cycle. The schematic representation 158 may be used to represent a loop antenna in the arrays of this disclosure.

Both the dipole antenna 102 of FIG. 1A and the loop antenna 152 of FIG. 1D are omni-directional antennas. An omni-directional antenna is an antenna that radiates signals with approximately the same amplitude in all directions in a given plane. As shown in FIGS. 1C and 1F, the radiation patterns for the dipole antenna 102 and loop antenna 152 are omnidirectional in the given plane. With respect to the dipole antenna 102, the antenna is omnidirectional in the plane perpendicular to the length of the dipole antenna 102. With respect to the loop antenna 152, the antenna is omnidirectional in the plane of the loop antenna 152.

Although both dipole antenna 102 and the loop antenna 152 are omni-directional antennas, they are not unidirectional antennas. A unidirectional antenna is an antenna that radiates a signal relatively uniformly in all directions, whereas an omnidirectional antenna radiates in a signal relatively uniformly in all directional within a given plane. For example, the dipole antenna 102 and the loop antenna 152 produce radiation patterns 106, 156 that have a donut shape. In one plane, the dipole antenna 102 and the loop antenna 152 have an omnidirectional pattern and the other plane the dipole antenna 102 and the loop antenna 152 have a figure-eight shaped pattern. The figure-eight shaped pattern includes a null (i.e., zero radiation) in a given direction. Therefore, when operated in the omni-directional plane, both dipole antenna 102 and the loop antenna 152 transmit radiation with a relatively uniform distribution.

Figure 2:
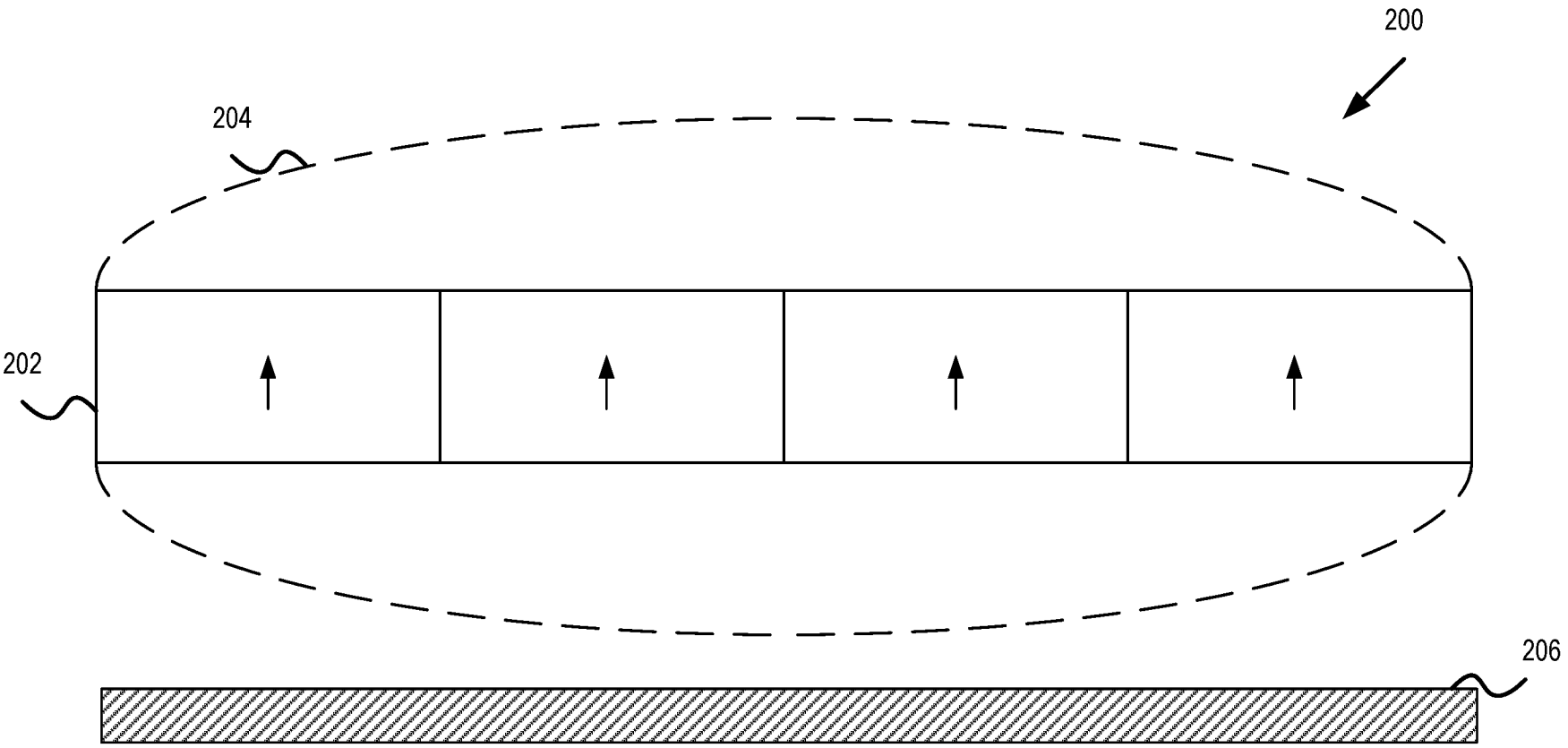
FIG. 2 (prior art)
FIG. 2 is a diagrammatic representation of a conventional array with two dipole antennas.

FIG. 2 is a diagrammatic representation 200 of an example conventional array 202 having a radiation pattern 204. As shown in FIG. 2, antennas make up the array 202. The four antennas have similar rotations shown by the arrows, when the signal excitation is, for example, in positive cycle. The arrows for each antenna may indicate the electric or magnetic field vector for the given antenna and convention used in FIGS. 1B and 1E. As aligned in array 202, each antenna in insolation would have an omnidirectional radiation pattern in the plane of the sheet. However, when the array is formed and all the antennas are driven with a signal, the coupling between the antennas forms an aggregate radiation pattern.

When the antennas of the array 202 radiate, the antennas produce a radiation pattern 204. The radiation pattern 204 is a summation of the radiation pattern of the various antennas that form the array 202. As shown in FIG. 2, a radiation pattern 204 for a linear array typically is symmetric around the array 202. Thus, radiation pattern 204 has a main lobe having a relative maximum in the direction substantially perpendicular to the array and a back lobe having a relative minimum along the direction of the array. Additionally, the spacing between the antenna elements of the array 202 may be equal to approximately a full wavelength of the desired frequency of electromagnetic radiation. In some examples, the frequency may be a center of a bandwidth of a frequency of operation. In other examples, the frequency may be a frequency within the bandwidth of operation of the array 202. In some further examples, the array may be able to steer the beam by controlling amplitude and phase of excitation signals of the various antennas, causing the main lobe and the back lobe to have an angle with respect to the array that is not perpendicular.

At minimum, and similar to regular phased array antennas, the amplitude and phase excitations can be controlled to have a relative maximum radiation toward a specific angle (i.e., beam steering), or a relative minimum radiation at another angle (null steering), or perform concurrent beam steering and null steering for different angles. More specifically, by applying the superposition of electromagnetic waves, the phase and amplitude excitations of the antenna or elements may be designed to have pre-determined main, back, and side-lobe level performance. For explanation purposes, the present disclosure will describe the array as having a beam steered perpendicular to the array, although other angles are possible as well. The arrays of the present disclosure may be used with steered beams as well.

As previously stated, during the operation of array 202, the array 202 radiates signals in both directions away from the array 202 in a full signal cycle. Thus, when the array 202 is mounted on a structure, such as an aircraft, the array 202 may be operated to radiate signals both toward the aircraft, as well as away from the aircraft. Radiating signals toward the aircraft is generally undesirable. In order to prevent signals from radiating toward the aircraft, the array may be coupled to or located near a metallic ground plane 206. The metallic ground plane 206 may reflect signals radiated toward the aircraft away from the aircraft. However, the metallic ground plane 206 may have some negative aspects as well. For example, the metallic ground plane 206 may also reflect other incoming radio signals as well. For example, incoming radar signals may also be reflected (and therefore detected). Thus, it may be desirable to create an array that radiates only in one direction—away from the aircraft—without need of the metallic ground plane 206.

Figure 3A:
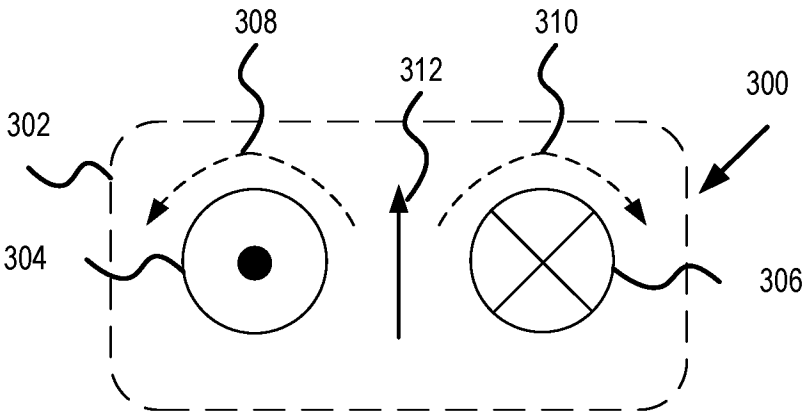
FIG. 3A is a diagrammatic representation of an example loop antenna.

FIG. 3A is a diagrammatic representation 300 of a loop antenna 302 having a first arm 304 having electrical current flowing in a direction out of the sheet and a second arm 306 having electrical current flowing in a direction into the sheet. As shown in FIG. 3A, the loop antenna 302 is depicted in a cross-section. Thus, the first arm 304 and the second arm 306 are two portions that form a full loop. When the loop antenna 302 is fed, current flows in a circular path around the loop. In FIG. 3A, current is shown flowing out of the sheet by the first arm 304 and into the page by way of second arm 306.

Because the antenna is a loop, when current flows through the first arm 304, the current also flows through the second arm 306 in the opposite direction. As current flows through the first arm 304, the current forms a first magnetic field 308 according to the right hand rule. Similarly, as current flows through the second arm 306, the current forms a second magnetic field 310 according to the right hand rule. During the operation of the loop antenna 302, the first magnetic field 308 and the second magnetic field 310 may sum together and form a combined magnetic field 312, between the first arm 304 and the second arm 306. The magnetic field 312 arrow may be used in a schematic representation of the example loop antenna (similar to that described with respect to FIG. 1E).

Figure 3B:
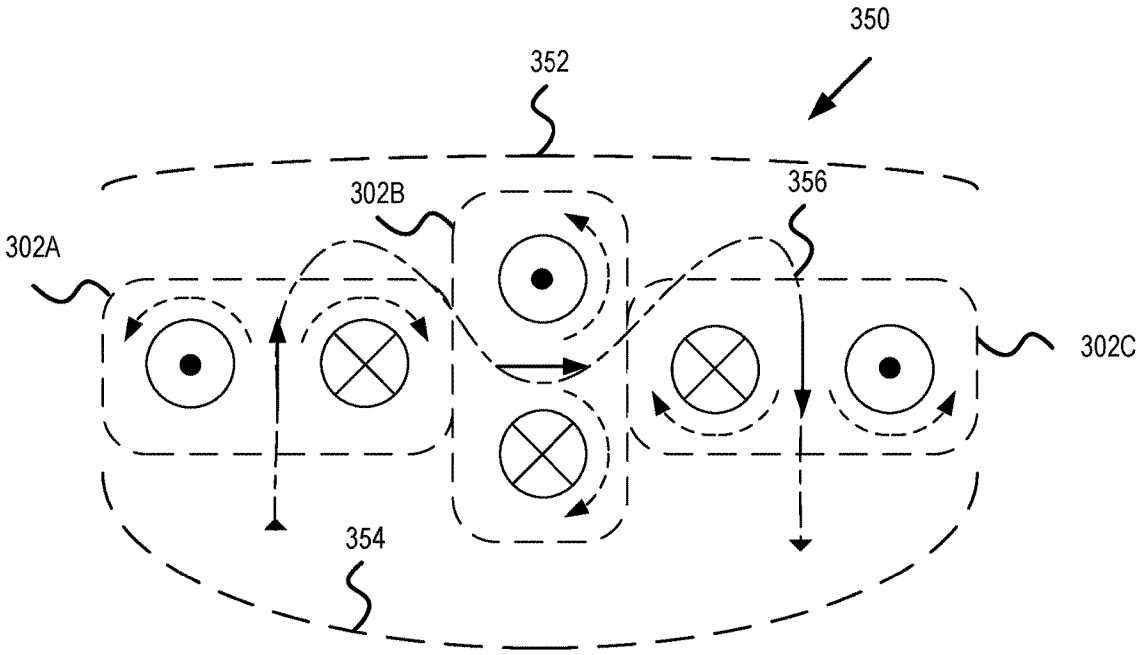
FIG. 3B is a diagrammatic representation of three loop antennas forming an example non-reciprocal antenna.

With respect to one example of the present invention, FIG. 3B is a diagrammatic representation of an array 350 of three loop antennas 302A-302C, first loop antenna 302A, second loop antenna 302*b*, and third loop antenna 302C forming a non-reciprocal antenna array. Loop antennas 302A-302C may each be similar to antenna 302 described with respect to FIG. 3A. The non-reciprocal antenna array has a radiation pattern that is low 352 in one direction and a radiation pattern that is high 354 in an opposite direction. The low 352 radiation pattern may correspond to a radiation pattern that transmits almost no signal. The high 354 radiation pattern may correspond to a radiation pattern that transmits almost a large percentage of the transmitted signal. The three loop antennas 302A-302C each have a rotation that is 90 degrees from the adjacent antenna, and antenna 302C has a 180-degree rotation from antenna 302A.

During the operation of the three loop antennas 302A-302C, there is a magnetic coupling between the different antennas. The magnetic coupling and the antenna rotations causes the antenna array to radiate radiation pattern that is low 352 in one direction and a radiation pattern that is high 354 in an opposite direction. Dashed line 356 indicates the field coupling between the three loop antennas 302A-302C to show how the fields are strong in one direction and weak in the other. In some examples, the radiation pattern that is low 352 may be zero or close to zero (e.g., such as +/−a tolerance resulting in effectively zero). Thus, the array 350 may be a "non-reciprocal" array that is due to the placement and rotations of the loop antennas 302A-302C, and the array functions primarily in one direction and not in the opposite direction. Therefore, the array 350 may not need a metallic ground plane, in contrast to the antenna array discussed with respect to FIG. 2.

Although FIG. 3B is shown with loop antennas, it may similarly be realized using dipole antennas (or other omni-directional antenna elements). When antenna elements other than loop antennas are used, the same rotations may be used as shown in FIG. 3B. Additionally, the array 350 may be considered a unit-cell of an array. Multiple unit cells may be repeated with the same quantity of omni-directional antennas aligned in the same orientation to form a periodic array having the functionality described with respect to array 350.

Figure 4:
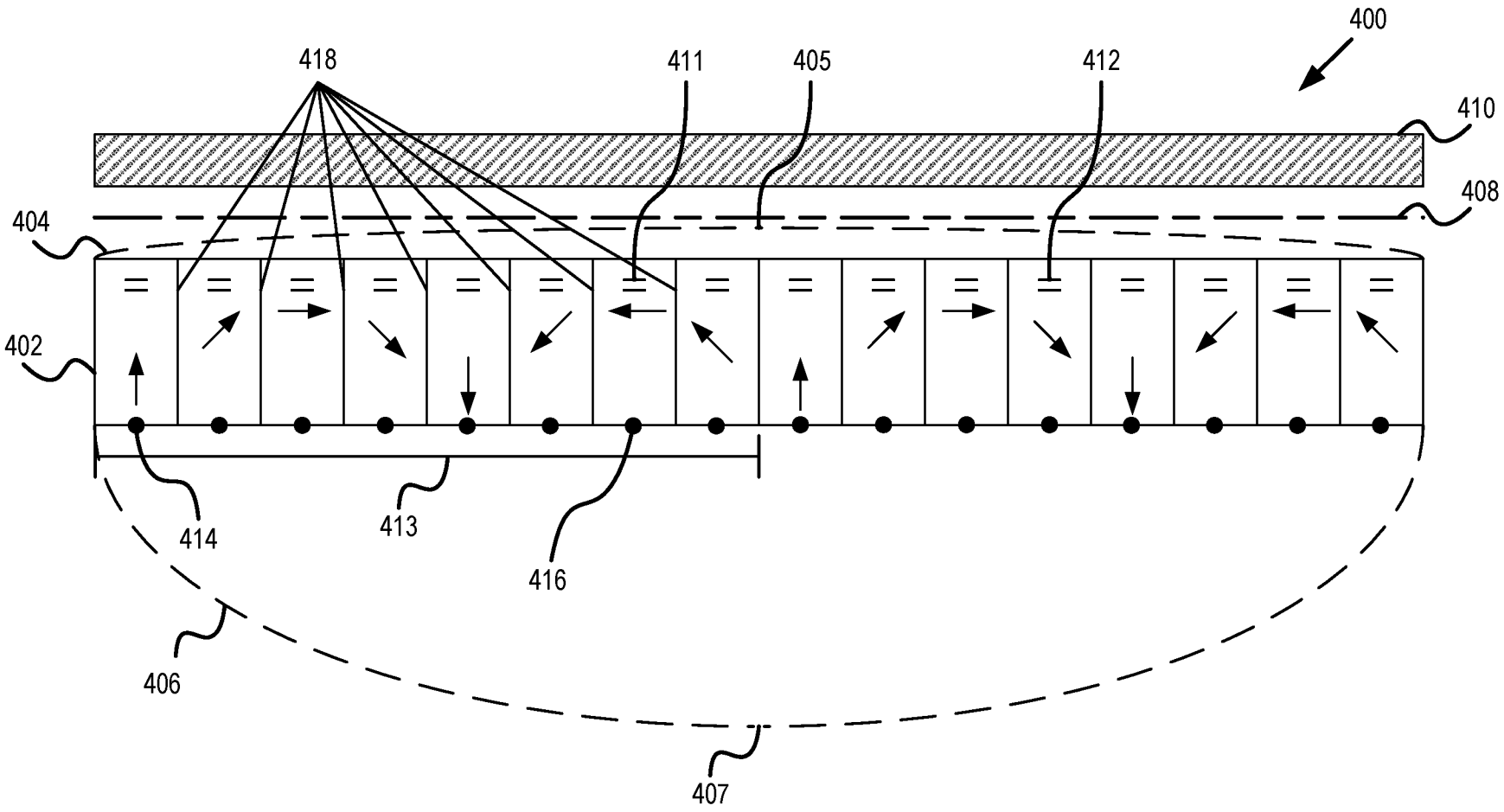
FIG. 4 is a diagrammatic representation of an example non-reciprocal array.

FIG. 4 is a diagrammatic representation of an antenna system 400 including a non-reciprocal array 402. The non-reciprocal antenna array 402 has a radiation pattern with a back lobe 404 having a relative minimum 405 in one direction and a main lobe 406 having a relative maximum 407 in an opposite direction. The arrangement of antennas in the non-reciprocal array 402 may form a simulated perfect magnetic conductor 408 behind the array. Additionally, in some examples, the non-reciprocal array 402 may include a radio-absorbing layer 410 in the direction where the non-reciprocal array 402 radiates a low amount of energy.

The non-reciprocal array 402 may be an array comprised of antenna elements having the rotations indicated by the arrows for each respective antenna. Each antenna has a respective feed, such as feed 411 and feed 412, which are shown as representative examples, and the feeds of the antennas together make up a set of antenna feeds. As further shown in FIG. 4, the antennas have a 45-degree rotation with respect to the adjacent antenna and the rotation increases from left to right. Therefore, as shown in FIG. 4, there are two eight-element arrays next to each other. Each set of eight antenna elements may be known as one period. Each of the eight-arrays may have length 413 that is equal to approximately one wavelength of operation for the array. As previously discussed, in some examples, the frequency may be a center of a bandwidth of a frequency of operation. In other examples, the frequency may be a frequency within the bandwidth of operation of the array 402. As also shown in FIG. 4, the antennas in the non-reciprocal array 402 are linearly aligned with a phase center of each antenna (e.g., phase center 414 and phase center 416) on a line. Further, in each period, the antenna spacing 418 between adjacent antennas in the period can be equal to 360 degrees divided by the quantity of antennas in the period.

Because the non-reciprocal array 402 radiates primarily in one direction due to the rotation of the antennas and their magnetic coupling, the array may simulate a perfect magnetic conductor 408 behind the array. A perfect magnetic conductor is a theoretic surface that reflects electromagnetic fields and induces a 0-degree phase shift when doing so (unlike a perfect electric conductor that introduces a 180-degree phase shift). Thus, the non-reciprocal array 402 functions as if there is a perfect magnetic conductor behind the array. Because the simulated perfect magnetic conductor 408 is not a real element, when the arrays that form non-reciprocal array 402 are not active, the antenna system 400 will not reflect incoming radio waves like an array that has a metallic ground plane.

Further, the antenna system 400 may also include a radio-absorbing layer 410 behind the non-reciprocal array 402. The radio-absorbing layer 410 may additionally absorb income radio signal and reduce the reflection of incoming radio signals. Conventional arrays likely cannot or do not have a radio-absorbing layer 410 near the array, as the radio-absorbing layer 410 would cause the array to perform poorly. Additionally, conventional arrays generally have a metallic ground plane to reflect electromagnetic energy. Therefore, for arrays that do not function in the non-reciprocal manner of the disclosed arrays, the benefits of the radio-absorbing layer 410 may not be appreciated.

Figure 5:
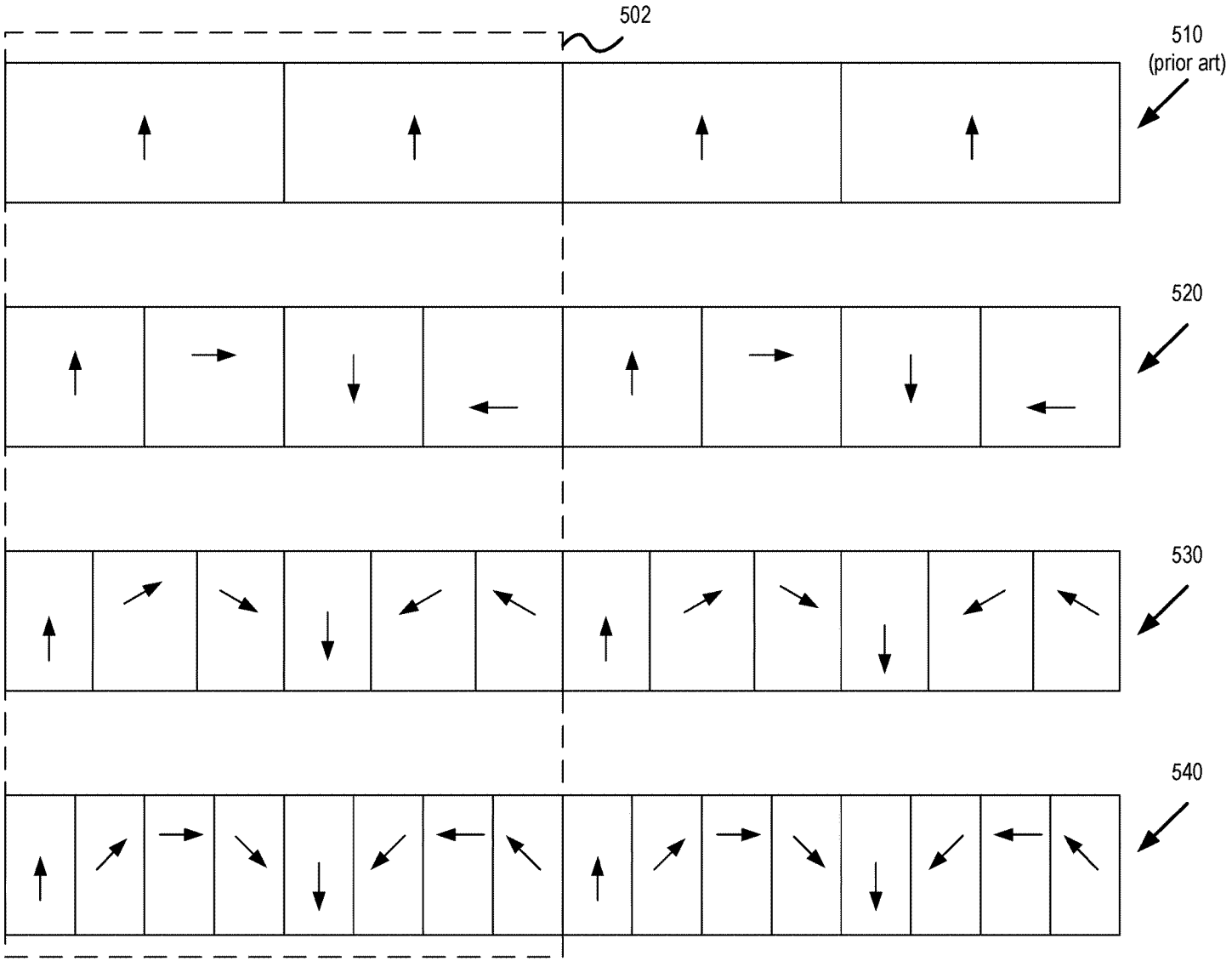
FIG. 5 is a diagrammatic representation of several non-reciprocal arrays having a different number of antennas per period.

FIG. 5 is a diagrammatic representation of several non-reciprocal arrays having a different number of antennas per period 502. The array 510 shows a conventional array with the antenna elements all pointed in the same direction. The non-reciprocal array 520 has four antennas per period 502. The non-reciprocal array 530 has six antennas per period 502. The non-reciprocal array 540 has eight antennas per period 502. FIG. 5 demonstrates the scalability of the presently-disclosed non-reciprocal arrays. The arrays shown in FIG. 5 may be periodic structures. A period structure is a structure that has features that repeat for each given period. FIG. 5 presents one example where the structures in period 502 are repeated twice. In various examples, the number of periods may increase to a number larger than two as well.

As previously discussed, the period 502 may be a length equal to a full wavelength, or λ, at the operating frequency. As more antennas are added to a period 502, the rotation between the various antenna elements may be reduced. The rotation between elements may be defined by the function:

$$\text{rotation} = \frac{360 \text{ degrees}}{\text{Number of Elements in } \lambda}$$

As more elements are added, the magnetic coupling between the antenna elements is increased, leading to better performance of the array with respect to its non-reciprocal functionality.

Figure 6:
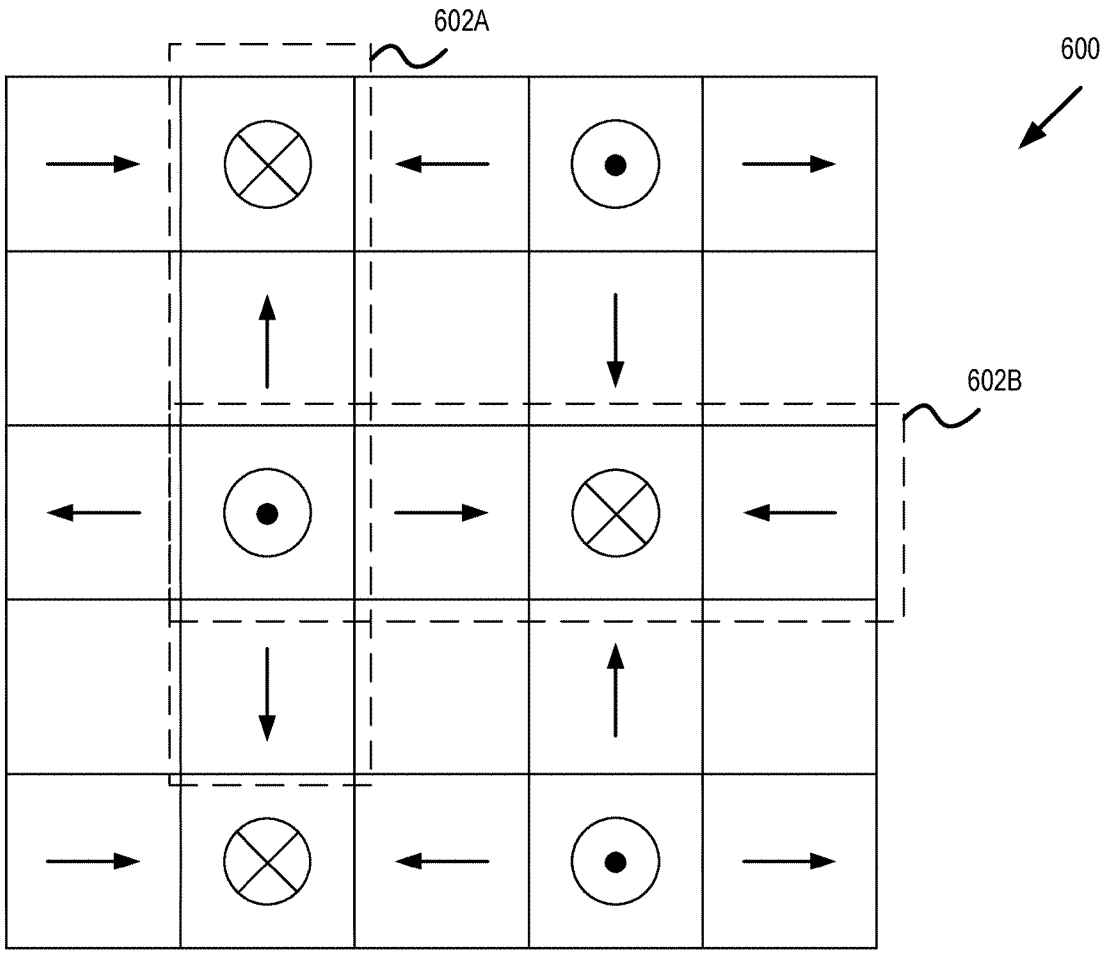
FIG. 6 is a diagrammatic representation of an example two-dimensional non-reciprocal array.

FIG. 6 is a diagrammatic representation of a two-dimensional non-reciprocal array 600. FIG. 6 may represent a top-down view of the two-dimensional non-reciprocal array 600. In the arrangement shown in FIG. 6, the two-dimensional non-reciprocal array 600 may be configured to radiate a strong signal in the direction out of the page and a weak signal in the direction into the page.

The two-dimensional non-reciprocal array 600 may be made of a periodic structure defined by the period 602A. The periodic structure includes multiple periods that are repeated with each having the same quantity of omni-directional antennas in the same orientation as each other period. The periodic structure may be repeated in both the left and right direction, as well as the up and down direction to produce a two-dimensional array. As shown in period 602A, a first antenna may have a current into the page (indicated by the X in the circle), a second antenna having a current in the upward direction (indicated by the upward arrow), a third antenna having a current out of the page (indicated by the dot in the circle), and a fourth antenna having a current in the downward direction (indicated by the downward arrow). The four antennas in period 602A may each have a rotation that is 90-degrees from the adjacent antennas. The same periodic antenna arrangement is also shown in period 602B, but in a different direction. To create the two-dimensional array, the periodic structure can be repeated multiple times in both the left and right direction and the up and down direction. Within the context of the present disclosure, the number of antennas in a period of the two dimensional array may be varied. In some examples, the number of antennas in a period may be different in the vertical and horizontal directions. In some other examples, the number of antennas in a period may be the same in both directions.

Figure 7:
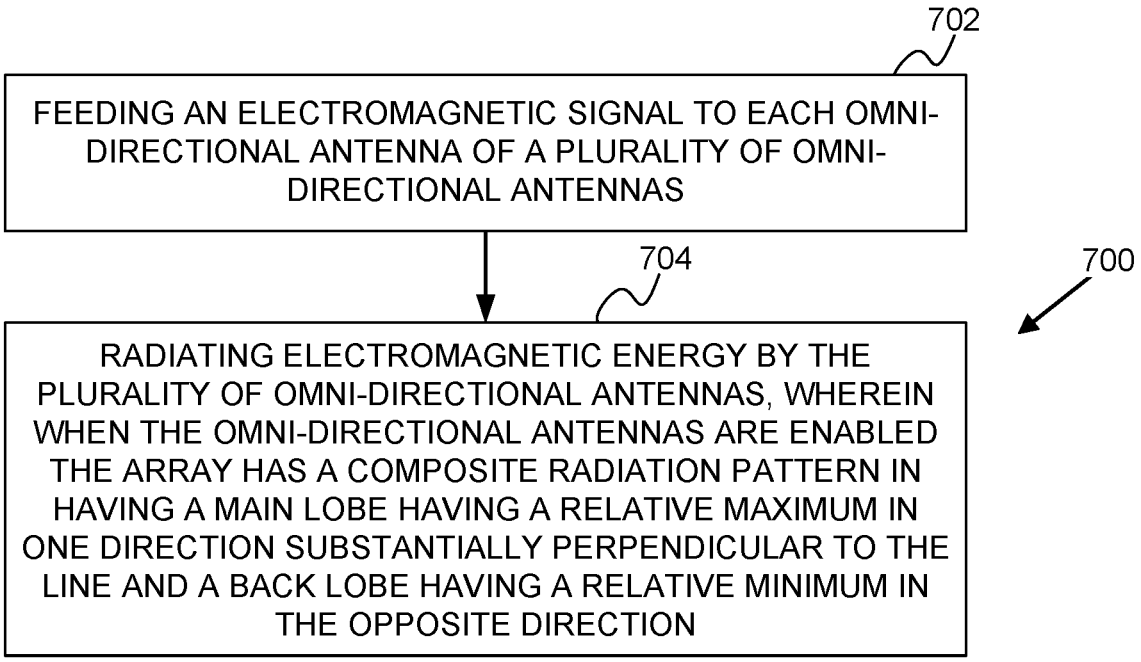
FIG. 7 is a diagrammatic representation of an example method for use with the non-reciprocal arrays disclosed herein.

FIG. 7 is a diagrammatic representation of an example method 700 for use with the non-reciprocal arrays disclosed herein. At block 702, method 700 includes feeding an electromagnetic signal to each omni-directional antenna of a plurality of omni-directional antennas. The feeding of the omni-directional antennas may be performed where the plurality of omni-directional antennas are aligned with a phase center of each antenna in a line. Additionally, the feeding of the antennas is configured to selectively enable or disable the plurality of antennas simultaneously.

The spacing of the elements in the array and the rotation of the various elements may cause the array to operate in a non-reciprocal manner. A non-reciprocal array, as previously discussed, is an array that uses omni-directional antenna elements, but produces an array that radiates a signal in one direction, and zero (or approximately zero) signal in the opposite direction.

At block 704, the method includes radiating electromagnetic energy by the plurality of omni-directional antennas, wherein when the omni-directional antennas are enabled, the array has a composite radiation pattern in having a main lobe having a relative maximum in a desired radiating direction approximately perpendicular to the line and a back lobe having a relative minimum in the opposite direction. Additionally, at block 704, the method may also include the radiation of each omni-directional antenna is in a direction having a rotation respective to the line and the radiating is performed by antennas having a spacing that equals 360 degrees divided by a quantity of antennas in a period between adjacent omni-directional antennas.

In some examples, at block 702 of method 700, the feeding is performed to a set of omni-directional antennas comprising 2 to 6 antennas. The set of antennas may form one set that is repeated periodically to form the array. Additionally, in some examples, the array may be a two dimensional array.

In some examples, at block 704 of method 700, the method may further comprise, when the omni-directional antennas are disabled, absorbing incoming electromagnetic energy with a radio absorbing layer. Additionally, in some examples, at block 704 of method 700, the method further includes radiating electromagnetic energy by the plurality of omni-directional antennas in a direction and creating a simulated perfect magnetic conductor in the opposite direction of the direction of the radiation.

Figure 8:
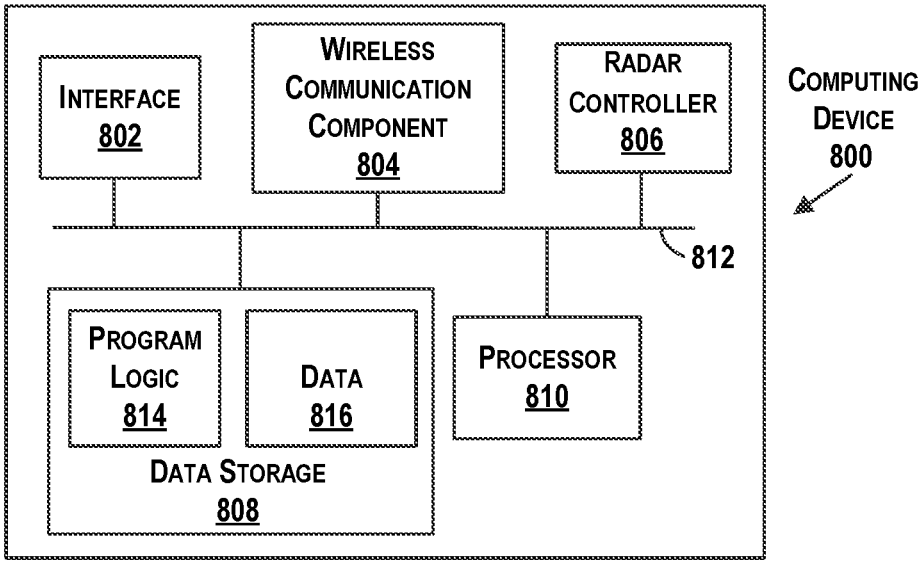
FIG. 8 is a diagrammatic representation of an example computing device that may be configured to control some of the operation of arrays.

A computing device 800 may be configured to control some of the operation of arrays disclosed herein. The computing device 800 may include an interface 802, a wireless communication component 804, radar controller 806, data storage 808, and a processor 810. Components illustrated in FIG. 8 may be linked together by a communication link 812. The computing device 800 may also include hardware to enable communication within the computing device 800 and between the computing device 800 and another computing device (not shown), such as a server entity. The hardware may include the radar system, such as transmitters, receivers, and antennas, for example.

The data storage 808 may store program logic 814 that can be accessed and executed by the processor 810. The data storage 808 may also store collected sensor data and/or radar data as the data 816. For example, the processor 810 may use the data 816 to selectively enable and disable radar units by way of the radar controller 806.

By the term "substantially", "about", and "approximately" used herein, it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

Different examples of the system(s), device(s), and method(s) disclosed herein include a variety of components, features, and functionalities. It should be understood that the various examples of the system(s), device(s), and method(s) disclosed herein may include any of the components, features, and functionalities of any of the other examples of the system(s), device(s), and method(s) disclosed herein in any combination or any sub-combination, and all of such possibilities are intended to be within the scope of the disclosure.

The description of the different advantageous arrangements has been presented for purposes of illustration and description, and is not intended to be exhaustive or limited to the embodiments in the form disclosed. Many modifications and variations will be apparent to those of ordinary skill in the art. Further, different embodiments may provide different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A non-reciprocal antenna array comprising:

a plurality of omni-directional antennas linearly aligned with a phase center of each omni-directional antenna of the plurality of omni-directional antennas on a line in a periodic arrangement, wherein each omni-directional antenna has an antenna rotation respective to the line and a length of a period of the periodic arrangement approximately equals an operational wavelength;

an antenna spacing between the omni-directional antennas of the plurality of omni-directional antennas, the antenna spacing equaling 360 degrees divided by a quantity of omni-directional antennas that form the period; and a set of antenna feeds corresponding to one feed for each omni-directional antenna of the plurality of omni-directional antennas, wherein the set of antenna feeds is configured to selectively enable or disable one or more of the plurality of omni-directional antennas, wherein when the plurality of omni-directional antennas are enabled the antenna array has a composite radiation pattern having a main lobe having a relative maximum in one direction substantially perpendicular to the line and a back lobe having a relative minimum in an opposite direction.

2. The antenna array of claim 1, further comprising a plane, wherein each omni-directional antenna of the plurality of omni-directional antennas is aligned with the phase center of each other omni-directional antenna of the plurality of omni-directional antennas on the plane, wherein the antenna rotation of each omni-directional antenna of the plurality of omni-directional antennas comprises an antenna rotation respective to the plane, and wherein the plurality of omni-directional antennas are aligned in a two-dimensional array.

3. The antenna array of claim 1, wherein the period equals a wavelength at an operating frequency of the antenna array.

4. The antenna array of claim 1, wherein the plurality of omni-directional antennas comprise dipole antennas.

5. The antenna array of claim 1, wherein the plurality of omni-directional antennas comprise loop antennas.

6. The antenna array of claim 1, wherein the antenna rotation is defined based on a null of a radiation pattern of each respective omni-directional antenna of the plurality of omni-directional antennas.

7. The antenna array of claim 6, further comprising four omni-directional antennas per period and wherein the antenna array comprises alternating loop and dipole antennas.

8. The antenna array of claim 1, wherein when the omni-directional antennas are enabled, the antenna array approximates a perfect magnetic conductor in one direction perpendicular to the antenna array.

9. The antenna array of claim 1, wherein the antenna array comprises a radio-absorbing layer.

10. The antenna array of claim 1, comprising between 2 and 6 antennas per period.

11. The antenna array of claim 1, wherein the antenna array comprises multiple periods, each period comprising the same quantity of omni-directional antennas in the same orientation as each other period.

12. A method of operating an antenna array, comprising:

feeding an electromagnetic signal to each omni-directional antenna of a plurality of omni-directional antennas, where the plurality of omni-directional antennas are aligned with a phase center of each omni-directional antenna of the plurality of omni-directional antennas in a line in a periodic arrangement, each period having a quantity of antennas, and wherein the feeding is configured to selectively enable or disable the plurality of omni-directional antennas simultaneously and a length of the period approximately equals an operational wavelength; and radiating electromagnetic energy by the plurality of omni-directional antennas, wherein radiation of each omni-directional antenna of the plurality of omni-directional antennas is in a direction having a rotation respective to the line and the radiating is performed by each period of the plurality of omni-directional antennas having a spacing that equals 360 degrees divided by a quantity of omni-directional antennas that form the period, wherein when the plurality of omni-directional antennas are enabled, the antenna array has a composite radiation pattern having a main lobe having a relative maximum in one direction and a back lobe having a relative minimum in the opposite direction.

13. The method of claim 12, wherein the feeding is performed to a set of omni-directional antennas comprising 2 to 6 antennas.

14. The method of claim 12, further comprising, when the plurality of omni-directional antennas are disabled, absorbing incoming electromagnetic energy with a radio absorbing layer.

15. The method of claim 12, wherein the feeding is of a plurality of omni-directional antennas aligned in a two dimensional array.

16. The method of claim 12, further comprising steering an angle of the main lobe based on an adjustment of a phase or amplitude of an electromagnetic signal of the feeding an electromagnetic signal to each omni-directional antenna.

17. A periodic two-dimensional antenna array comprising:

a plurality of omni-directional antennas arranged periodically, each period having a quantity of omni-directional antennas, wherein each omni-directional antenna:

is aligned with a phase center of each other omni-directional antenna of the plurality of omni-directional antennas on a plane of the antenna array, has an antenna rotation respective to the plane, and has an antenna spacing between an adjacent omni-directional antenna equaling 360 degrees divided by the quantity of omni-directional antennas in the period; and, a set of antenna feeds corresponding to one feed for each omni-directional antenna of the plurality of omni-directional antennas, wherein the set of antenna feeds is configured to selectively enable or disable one or more of the plurality of omni-directional antennas, wherein when the plurality of omni-directional antennas are enabled, the antenna array has a composite radiation pattern having a maximum in one direction perpendicular to the plane and a minimum in an opposite direction.

18. The periodic two-dimensional antenna array of claim 17, comprising between 2 and 6 antennas per period.

19. The periodic two-dimensional antenna array of claim 17, wherein when the omni-directional antennas are enabled, the antenna array approximates a perfect magnetic conductor in a direction perpendicular to the antenna array.

20. The periodic two-dimensional antenna array of claim 17, wherein the antenna array has an operating frequency and a length of the period approximately equals a length of a wavelength at the operating frequency.

* * * * *